United States Patent [19]

Patenaude

[11] 4,192,104

[45] Mar. 11, 1980

[54] DUST SHROUD

[75] Inventor: James K. Patenaude, Easthampton, Mass.

[73] Assignee: Wilderness Mold, Inc., Northampton, Mass.

[21] Appl. No.: 949,883

[22] Filed: Oct. 10, 1978

[51] Int. Cl.[2] ..... B24B 55/06

[52] U.S. Cl. ..... 51/273; 144/252 R; 29/DIG. 84

[58] Field of Search ..... 51/273; 144/252 R; 29/DIG. 84, DIG. 87; 83/100

[56] References Cited

U.S. PATENT DOCUMENTS

| | | | |
|---|---|---|---|
| 790,943 | 5/1905 | Weber | 51/273 |
| 807,530 | 12/1905 | Yuerhs | 51/273 |
| 956,762 | 5/1910 | Furrow | 51/273 |
| 965,223 | 7/1910 | Plant | 51/273 |
| 967,729 | 8/1910 | Charpentier | 51/273 |
| 2,054,932 | 9/1936 | Fleming | 51/273 |
| 2,229,598 | 1/1941 | Nash | 51/273 |
| 2,789,404 | 4/1957 | Downing et al. | 51/273 |

*Primary Examiner*—Nicholas P. Godici
*Assistant Examiner*—Roscoe V. Parker
*Attorney, Agent, or Firm*—Ross, Ross & Flavin

[57] ABSTRACT

A vacuum unit comprises a dust confining shroud or casing which surrounds the major portion of a rotating abrading component and is provided with baffle means located relative to the component to define vacuum chambers on opposite sides of the component for effecting withdrawal of the objectionable generated dust from the work area.

1 Claim, 3 Drawing Figures

DUST SHROUD

The invention is an exhaust shroud or hood especially adapted for use with a vacuum operated exhaust system where a grinding wheel or other dust creating member is employed, enabling the dust laden air resultant from wheel rotation during operational use to be successfully removed away from the area of the grinding wheel and its supporting machine by entrainment thereof through one of a plurality of vacuum channels to a connecting suction line.

The prior art of which I am aware follows:

U.S. Pat. No. 790,943 of 5-30-05
U.S. Pat. No. 807,530 of 12-19-05
U.S. Pat. No. 956,762 of 5-3-10
U.S. Pat. No. 965,223 of 7-26-10
U.S. Pat. No. 967,729 of 8-16-10 and copies thereof are enclosed.

No reference shows the combination of a shroud circumadjacent the uppermost portion of the grinding component and having a bottom opening communicating with the machine and ambient air in its lowermost region with the shroud interior so partitioned as to define a primary vacuum channel serving to capture the generated dust as the grinding component ascends from 6 to 12 o'clock positions and with a secondary vacuum channel within the shroud serving to capture the dust as the grinding component moves in descendency from 12 to 6 o'clock positions. Nor do they teach a baffle arrangement serving to preclude the passage of negative pressure upwardly of the opposite side faces of the grinding component, where same is not needed, and further serving to define narrowed restrictive slots so that air forced therethrough increases in velocity in such passage, all so as to increase the suction in direct ratio.

It is comprehended that the apparatus will have special adaptation for machines involved with the grinding of say graphite or copper graphite electrodes. Heretofore, in such work, many manufacturers have, of necessity, stayed with the more expensive, and time consuming, copper tungsten, copper, or silver tungsten materials which, while not dusty, take longer in the manufacture of electrodes. Because of the economic factors involved, many shops are forced to the unpopular choice of grinding the more dusty materials, creating dirty and hazardous working conditions. With the equipment hereof, the more economical graphite electrode materials can be exploited.

Prior art conventional hoods or guards have used vacuum pick-up arrangements located distantly of the grinding component allowing the escape into the air of major portions of the generated dust.

Those experienced in the grinding art appreciate that in the grinding of such as graphite and like dusty materials, much of the small, lightweight dust particles are driven into the porous wheel periphery, there to stay unless centrifugal force will serve to drive the particles outwardly in the area of approximately 270° away from the contact point on the wheel, thereat only to be driven outwardly and away from the wheel and thence onto the grinding machine and/or into the surrounding area.

Contrariwise, this invention may be briefly summarized as comprising a vacuum unit which aspirates abrading dust through a dust-confining shroud or casing surrounding the major portion of a rotating abrading component of an abrading machine, the shroud being directly connected to a negative pressure line. Baffle means strategically disposed within the shroud divides the interior into a plurality of vacuum channels at opposite sides of the abrading component and aids in removing the dust tangentially away therefrom, in rearward directions, first from the area between the 6 and 12 o'clock positions of the component and along a first main vacuum channel, and second from the area between its 12 and 6 o'clock positions and along a secondary vacuum channel. The baffle means exploits the air speed generated by centrifugal force as the abrading component rotates and boosts the suction power. Some of the dust particles are projected into and withdrawn from the first or main vacuum channel and into the vacuum device. Other dust particles are driven into the porous periphery of the abrading component, where they remain so embedded, as the component ascends between 6 and 12 o'clock positions, but are driven outwardly therefrom as the component descends between 12 and 6 o'clock positions whereat the secondary vacuum channel serves to entrain them rearwardly of the shroud and through the suction line to the vacuum device, rather than downwardly and outwardly of the shroud with obvious deleterious effects with respect to the abrading machine supporting the abrading component, the ambient air, and the machine operator himself. The baffle means exploits the air speed as effected by the generated centrifugal force upon abrading component rotation, thereby boosting the suction power. The baffle means further minimizes the leakage of suction vertically upwardly of the opposite side faces of the abrading component when it is not needed and, if present, is wasted. Narrow slottings in the baffle means define restrictions so that air forced therethrough increases in velocity to increase the suction effect. These restrictions are in general alignment with the abrading component periphery so as to direct the maximum suction onto that periphery, where the dust has its genesis, and to tend to draw the dust particles out of its pores and out of the air cushion surrounding the component caused by its speed.

With this background in view, the invention comprises the exhaust hood and construction thereof and the associated vacuum operated exhaust system as hereinafter described and particularly defined in the annexed claims. That is, the invention contemplates the improved construction of exhaust shroud particularly adapted for use with a rotatable grinding component for removing the dust, grit and metal particles created during a grinding operation, which construction is designed to counteract the effect of the centrifugal force of the rotating wheel which normally tends to displace the air outwardly from the hood and accordingly greatly increases the efficiency of the dust removal characteristics of the system.

In known prior art systems, most of which operate in the absence of a vacuum incidentally, the grinding component is known to entrain air so as to set up air currents resulting in a strong outward flow of air from within the hood or shroud when an exhausting system is connected. Only a small part of the dust laden air enters the enclosure and the exhaust system used. The particles of dust, grit and metal leave the wheel at relatively high velocity and this movement together with the outward flow of the air causes the particles to continue outwardly of and beyond the enclosure with probably only the relatively heavy particles which are bodily thrust into the enclosure finding their way into the exhaust system.

Herein, means are provided for utilizing the displacement of air caused by the wheel rotation by applying the baffle means and adding vacuum to both sides of the wheel, all so as to set up forces at opposite sides for drawing the air inwardly away from the wheel at each side and counteracting the outward flow of air caused by centrifugal force, to the end that the hood serves with increased efficiency, removing practically all of the dust laden air adjacent the work.

Figure 1:
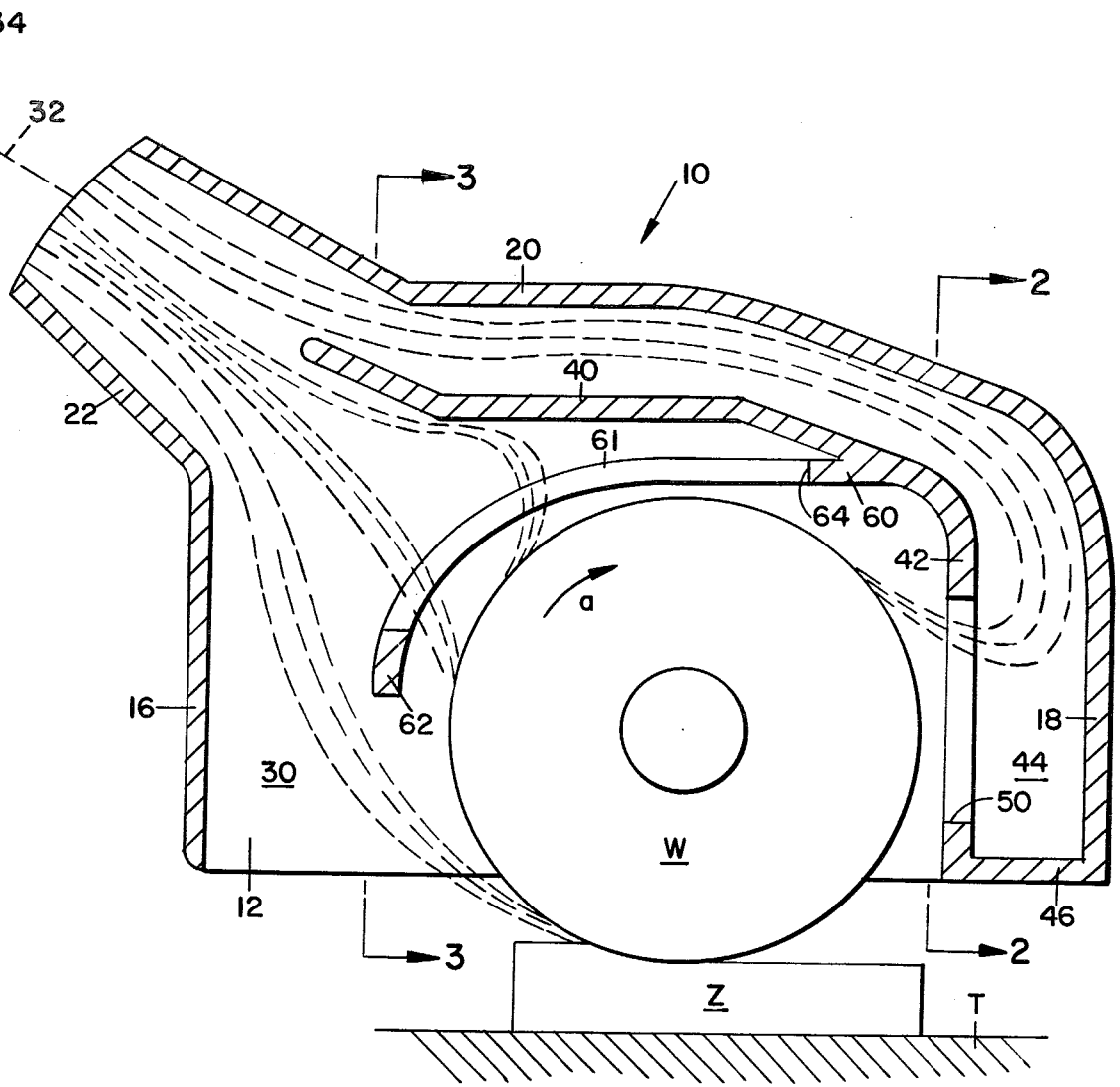
FIG. 1 is a sectional view along the vertical center line of the apparatus.
Figure 2:
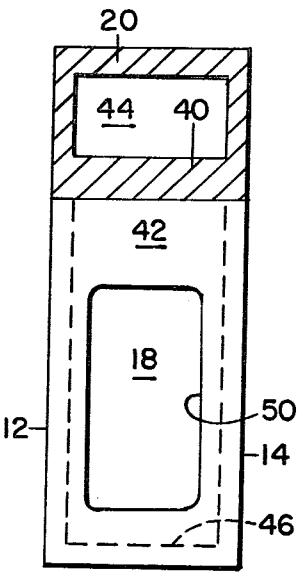
FIG. 2 is a sectional view on line 2—2 of FIG. 1.
Figure 3:
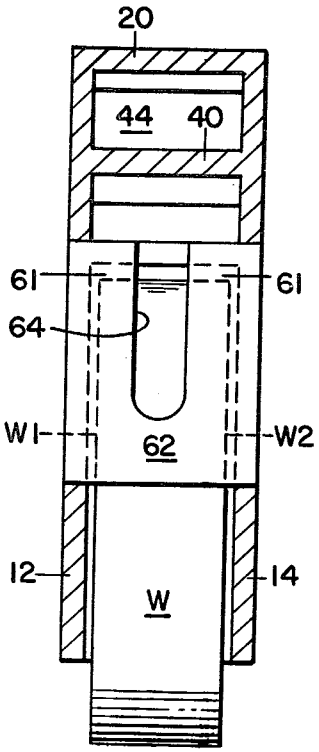
FIG. 3 is a sectional view on line 3—3 of FIG. 1.

With special reference to the drawing, the invention will be seen to comprise a shroud generally indicated by 10 formed to be strategically seated relative to a grinding machine or other device supporting a grinding wheel W so as to enclose the greater portion of said wheel. More particularly, it will be seen to enclose the entirety of the upper half of the wheel and more than one half of the lower half of the wheel and will be understood to be vertically adjustable so as to accommodate to different sizes of wheels and different types of work, all the while enclosing as much of the wheel as is practical.

For purposes of orientation, the wheel will be observed to be rotative in a clockwise rotation, as viewed, and as indicated by a, with a 6 o'clock position being recognized as that position closest to the work Z and a 12 o'clock position being recognized as the diametrically opposite position. The movement between 6 and 12 o'clock will represent the ascending movement of the wheel and the movement between 12 and 6 o'clock will represent the descending movement.

The shroud will be seen to be so mounted with respect to the supporting grinding machine (not shown) as to be disposed above the work which will be fixed on such as a table T of the machine.

The shroud comprises opposite side walls, a far side 12 and a near side 14 as viewed, a rearward vertical end wall 16 spaced between and connecting with the opposite side walls, a forward vertical end wall 18 spaced between and connecting with the opposite side walls, an inclined upper top wall 20 spaced between and connecting with the opposite side walls and merging at its forward terminus with forward end wall 18, and an inclined lower top wall 22 spaced between and connecting with the opposite side walls and merging at its forward terminus with the upper extremity of rearward end wall 16.

The rearward terminus of each of the upper and lower top walls 20 and 22 respectively and the terminus of the rearward upper portion of each side wall 12 and 14 cooperantly define a first main vacuum channel 30 which will be connected by piping represented by dashline 32 to any conventional vacuum source 34 forming part of the exhausting system.

A secondary wall 40 within the shroud extends between the side walls, is spaced somewhat below and generally parallel to upper top wall 20, and has a forward vertically extending wall portion 42 merging therewith and in like manner extending between the spaced side walls and spaced rearwardly from and generally parallel to wall 18, all to define a secondary air passage 44, said secondary wall having a rearward terminus which terminates adjacent the main air passageway 30 and having a forward terminus in the form of a secondary end wall portion 46 which extends between the lower extremities of walls 18 and 42.

Wall portion 42 is provided with an opening 50 therethrough to allow communication between the grinding wheel area and the secondary air passage, the opening having a width slightly less than the width of the grinding wheel W.

Extending rearwardly from secondary wall 40 at approximately the point of joinder of the wall with its wall portion 42 is a generally horizontally disposed tertiary wall 60 having a rearwardly extending arcuate tail portion 62 which curves generally downwardly and conforms to the curvature of and is spaced from the grinding wheel, the tertiary wall and its tail portion extending between and cast with side walls 12 and 14 and being provided with an opening 64 therethrough.

The area within the casing rearwardly of wheel W and wall portion 62 defines the primary air passage 30 which is divided into subpassages by virtue of the opening 64.

In the illustrated embodiment, a vacuum is produced in the casing such as to draw the dust laden air adjacent the work into the primary air passage as it is projected from the clockwise rotating grinding wheel W, the rotation being indicated by letter a, in contact with the work so that the greater portion of the dust is drawn rearwardly away from the wheel between the 6 o'clock and 12 o'clock positions thereof.

Other portions of the dirt and dust not so initially removed from the wheel between its 6 and 12 o'clock positions are caused to be removed from the wheel by virtue of the secondary vacuum passage through which a secondary part of the vacuum is induced.

Opening 64 is of a width much more narrow than the width of the grinding wheel so as to define a baffle means at opposite sides W1 and W2 of the wheel in the form of wall portions 61 and 61 which serve to so block off the direct communication with the suction means that force of the suction up the side faces of the wheel is minimized, same not being needed in that area and in fact being desirably reduced thereat so as to avoid wastage.

The narrowness of the opening 64 restricts the geometry thereof so that as air is forced therethrough, as in the case of any restricted area, the velocity thereof is accordingly increased and the force of the coacting suction is enhanced. This restriction is directly in line with the wheel periphery so as to direct the maximum suction on the periphery of the wheel where the dust has its genesis and tend to draw the dust particles out of the porous periphery and out of the air cushion surrounding the wheel caused by the speed of the wheel.

The wheel being porous, much of the dust is driven into the porous periphery. As the wheel turns, say at 3600 RPM it creates an air cushion around its periphery wich also captures the dust and carries it with the rotating wheel. Any of this dust that is not drawn out of the wheel by the narrow restriction is driven out by the centrifical force of the wheel at approximately 180° from the main vacuum channel. At this point, the secondary vacuum channel captures this escaping dust and carries it away through its chamber and into the vacuum system.

I claim:

1. In an exhaust system for a rotating abrading component of an abrading machine, the combination of:

a vacuum source, a shroud connected to the vacuum source and mounted on the abrading machine circumadjacent the major portion of the abrading component and having an opening in the bottom thereof through which the minor portion of the abrading component extends for operation on a workpiece, a secondary wall within the shroud for separating the shroud interior into a primary vacuum channel adjacent the ascending portion of the abrading component and a secondary vacuum channel adjacent the descending portion of the abrading component, an entrance opening in the secondary wall in line with the descending portion of the abrading component and communicating with the secondary vacuum channel, the entrance opening in the secondary wall being slightly narrower than the width of the abrading component, a tertiary wall within the shroud and spaced from and conforming to the curvature of the abrading component and having an entrance opening in line with the ascending portion of the abrading component and communicating with the primary vacuum channel, the entrance opening in the tertiary wall being of a width much more narrow than the width of the abrading component and than the width of the entrance opening in the secondary wall.

* * * * *